US006105857A

United States Patent [19]

Markey et al.

[11] Patent Number: 6,105,857

[45] **Date of Patent: *Aug. 22, 2000**

[54] ANTI-BOWING EASY OPENING CARTON

[75] Inventors: Kevin Joseph Markey, Westminster; Ronald Milio, Baltimore, both of Md.; Alan Fontaine, Louisville, Colo.

[73] Assignee: Lever Brothers Company, Division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/080,552

[22] Filed: May 18, 1998

Related U.S. Application Data

[63] Continuation of application No. 08/589,315, Jan. 22, 1996, abandoned, which is a continuation of application No. 08/301,145, Sep. 6, 1994, abandoned, which is a continuation of application No. 08/077,730, Jun. 16, 1993, abandoned.

[51] Int. Cl.[7] ..... B65D 5/54

[52] U.S. Cl. ..... 229/208; 229/102; 229/222; 229/244; 493/128

[58] Field of Search ..... 229/133, 223, 229/229, 102, 132, 136, 208, 222, 241, 243, 244; 493/63, 69–72, 79–81, 128, 183; 383/210, 211

[56] References Cited

U.S. PATENT DOCUMENTS

| | | | |
|---|---|---|---|
| 1,992,222 | 2/1935 | LaGrua | 229/208 |
| 2,259,822 | 10/1941 | Kienlen . | |
| 2,828,060 | 3/1958 | Brown . | |
| 2,852,180 | 9/1958 | Inman . | |
| 2,881,968 | 4/1959 | Inman . | |
| 2,884,180 | 4/1959 | Inman . | |
| 2,936,104 | 5/1960 | DeBlaere . | |
| 2,992,767 | 7/1961 | Inman . | |
| 3,015,432 | 1/1962 | Tyrseck . | |
| 3,113,713 | 12/1963 | Green . | |
| 3,163,347 | 12/1964 | Bixler . | |
| 3,182,887 | 5/1965 | Larson | 229/133 |
| 3,194,474 | 7/1965 | Rumerger . | |
| 3,261,536 | 7/1966 | Bixler | 229/133 |

OTHER PUBLICATIONS

Agreement between Graphic Packaging Corporation and Lever Brothers Company.

*Primary Examiner*—Gary E. Elkins
*Attorney, Agent, or Firm*—Gerald J. McGowan, Jr.

[57] ABSTRACT

A carton having one or more closure flaps with a delaminating window formed by lines which are not substantially straight in a direction parallel to the fold line separating the flap from the panel of the carton. Preferably, the delaminating window is formed from an undulating curve. The lack of straight lines tends to minimize the risk that bending will occur and interfere with the sealing of the carton. The invention also includes a process of sealing the cartons by adhering the delaminating window to another flap.

13 Claims, 3 Drawing Sheets

ANTI-BOWING EASY OPENING CARTON

This application is a continuation of application Ser. No. 08/589,315, filed Jan. 22, 1996, abandoned, which is a continuation of Ser. No. 08/301,145, filed Sep. 6, 1994, abandoned, which is a continuation of Ser. No. 08/077,730 filed Jun. 16, 1993, abandoned.

BACKGROUND OF THE INVENTION

To facilitate consumer access to household products, it is often attempted to provide packaging with easy opening features. In the case of soap bar cartons, for instance, previous efforts have included provision for weakening a portion of an underlying closure flap which is glued to an overlying flap. The underlying flap portion is weakened to such an extent that when the overlying flap is lifted the weakened portion of the underlying flap is torn from the underlying flap, thereby opening the carton. Specifically, a window may be created in the upper surface of the underlying flap which comprises cut scorelines generally parallel to, but recessed from, the rectangular boundaries of the flap, which window is glued to the overlying flap and delaminates when the overlying flap is pulled.

Patents disclosing weakened portions defined by scores or cuts include Brown U.S. Pat. No. 2,828,060, Tyrseck U.S. Pat. No. 3,015,432, Brastad U.S. Pat. Nos. 3,491,937 and 3,719,317 and Kienlen U.S. Pat. No. 2,259,822.

A problem attendant to the use of the previous window delaminating flaps is that there is a tendency for any cut scorelines parallel to the fold line separating the flap from the main panel to become fold lines in the processing of the package. The folding of the flap along cut scorelines can readily cause problems in the sealing of the package as where the cut scoreline folds in a direction lengthwise of the flap. Such lengthwise folding of the flap may make it difficult to adhere effectively the outer flap to the underlying flap.

Various types of cartons are disclosed in the prior art, including those illustrated in U.S. Pat. Nos. 2,852,180; 2,881,968; 2,884,180; 2,936,104 and 2,992,767.

Meyers U.S. Pat. No. 4,124,161 discloses that when sealing gases are applied to the top of the underlying flaps the flaps tend to droop, which interferes with sealing. Meyers makes a cut score along substantially the entire length of the top of the underlying flaps indented from the fold lines of the flap to provide sealing margins. The cut scores may be in the form of a straight line or in sine wave or other non-linear shapes shown in Meyers' FIG. 5. The non-linear scorelines are said to be stronger than the straight cut scorelines.

Redpath et al. U.S. Pat. No. 3,295,743 discloses a carton having a zigzag cut scoreline 31 extending across the front panel. Spots of adhesive are located between the zigzag cut scoreline 31 and the upper edge of the front wall when the carton is glued in tubular form. The arrangement is said to permit the outer surface of the panel to peel off readily when the carton is opened if the adhesive is bonded sufficiently not to come loose when the carton is opened.

Green U.S. Pat. No. 3,113,713 discloses glue applied in a special pattern of decreasing bonding area in the direction of pull allowing the ease of opening to be increased and the opening speed to be accelerated as pull is exerted. Triangular areas are illustrated.

SUMMARY OF THE INVENTION

It has been discovered that easy opening flaps including delaminating windows can be substantially improved by not forming such windows by substantially straight lines in a direction parallel to the fold line separating the flap from the panel of the carton. In a particularly preferred embodiment, the delaminating window is formed from an undulating curve running generally parallel to the fold line separating the underlying flap from its associated carton panel. The invention is also directed to a process of sealing a carton by adhering a delaminating window on one flap to a second flap wherein the delaminating window does not include a generally straight line extending generally parallel to a fold line separating the flap containing the delaminating window from a panel of the carton.

DETAILED DESCRIPTION OF THE INVENTION

Figure 1:
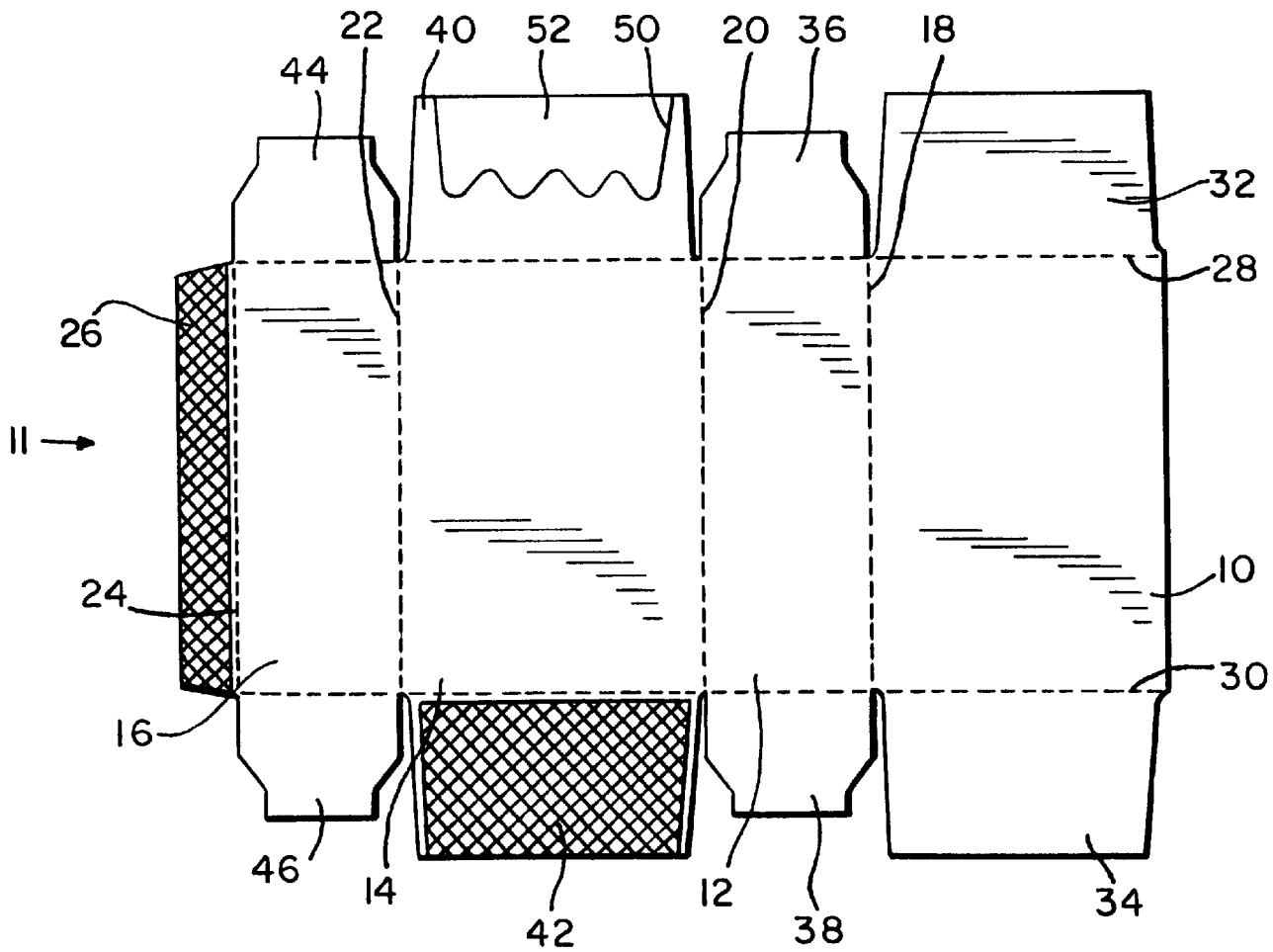
FIG. 1 is a top plan view of a blank suitable for use in the present invention.
Figure 2:
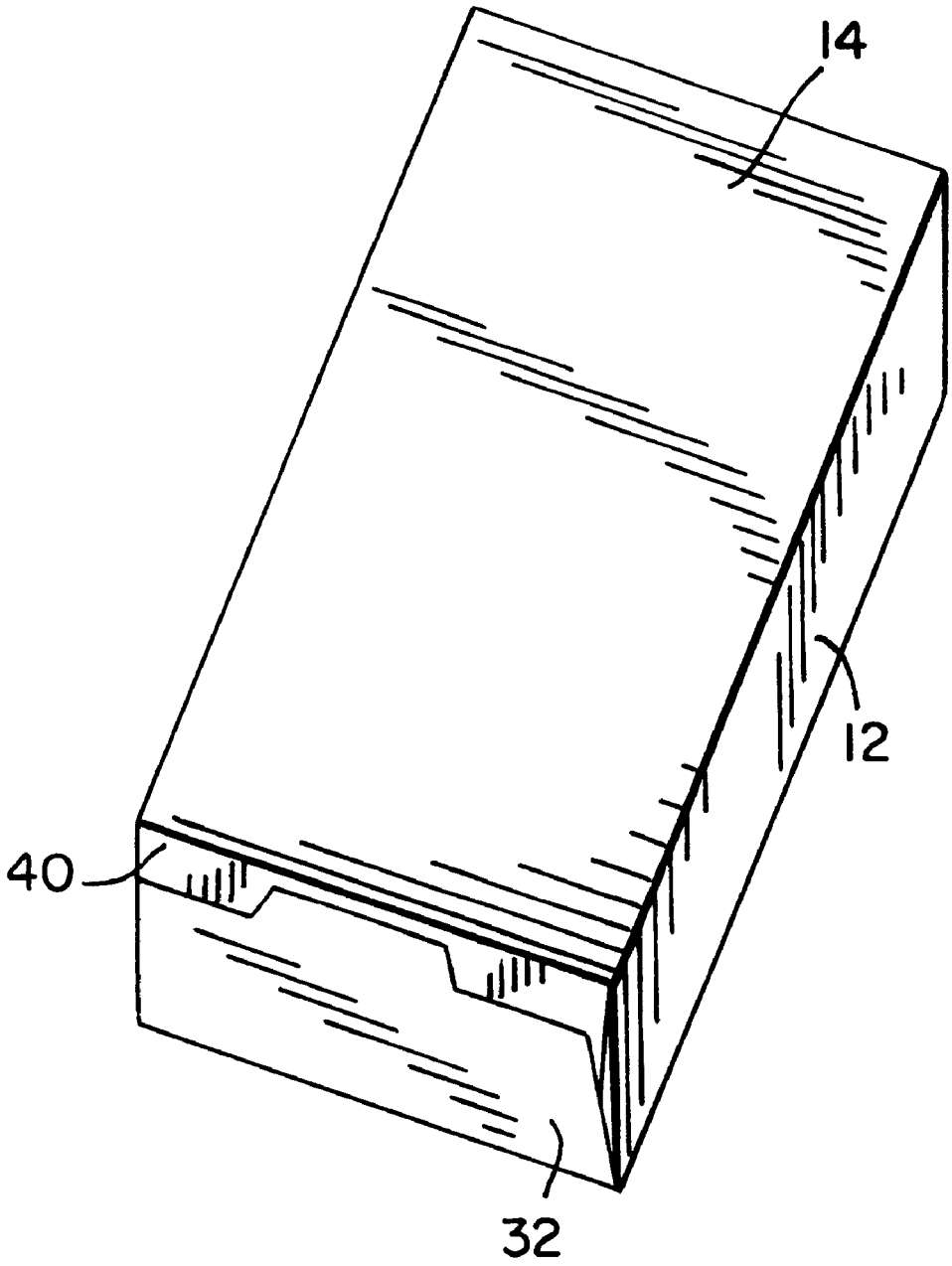
FIG. 2 is a perspective view of a carton according to the invention in the closed position.
Figure 3:
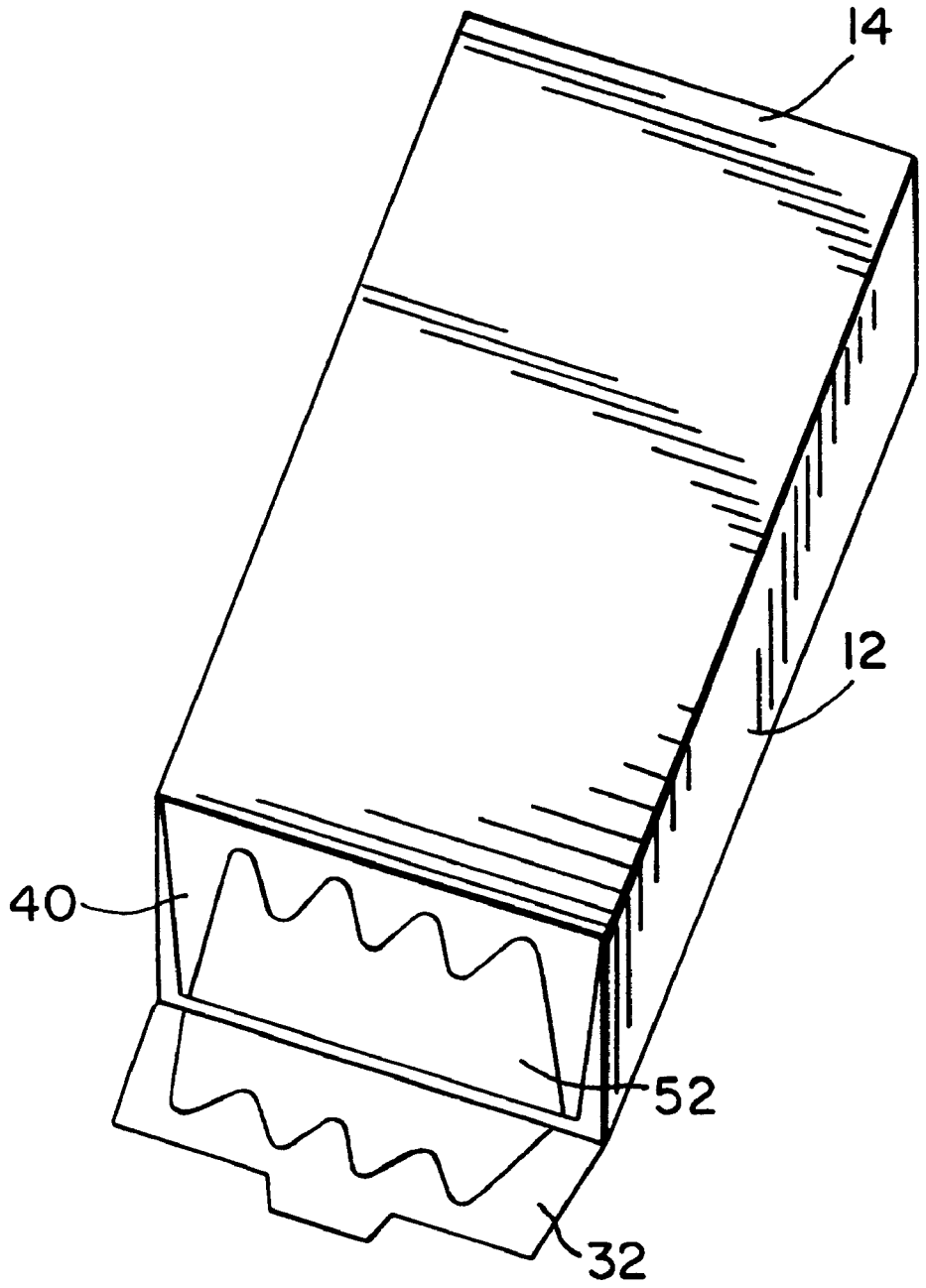
FIG. 3 is a perspective view of a carton of FIG. 2 wherein the overlying flap has been opened.

Carton blank 11 comprises front panel 14, first side panel 12 separated from front panel 14 by transverse scoreline 20, and rear panel 10 separated from first side panel 12 by transverse scoreline 18. Front panel 14 is separated on the side opposite first side panel 12 by scoreline 22 from second side panel 16. Scoreline 24 separates second side panel 16 from glue flap 26.

Scorelines 28 and 30 separate the carton panels from the closure flaps. Upper minor closure flaps 44 and 36 are separated respectively from second and first side panels 16 and 12 by scoreline 28. Likewise, lower minor closure flaps 46 and 38 are separated by scoreline 30 from second and first side panels 16 and 12.

Upper overlying or outside major closure flap 32 is separated from rear panel 10 by scoreline 28. Lower outside closure flap 34 is separated from rear panel 10 by scoreline 30. Upper underlying or inside major closure flap 40 is separated from front panel 14 by scoreline 28 whereas lower inside or underlying major flap 42 is separated from front panel 14 by scoreline 30.

As illustrated in FIG. 1, the minor closure flaps are not attached laterally to the major closure flaps.

In accordance with the invention, upper major underlying closure flap 40 is provided with a partially cut scoreline defining a delamination window 52. By delamination window it is meant that the partial cut scoreline forms at least three sides of a window. A fourth side may be provided by a free edge of the flap as illustrated. Alternatively, the fourth side of the window may be provided by another partially cut scoreline.

In accordance with the invention, the delamination window does not include a straight line parallel to the scoreline or fold line 28. This is significant in that where such straight lines are present, bending of the flap tends to occur, which bending interferes with sealing of the carton. The shape of any cut scorelines or other lines of weakness extending parallel to scoreline 28 can be of various forms. For instance, as illustrated a sinusoidal, undulating partial cut score is used, although other types of lines are possible. The flap including the delamination window as illustrated includes side edges on either side of the foldline separating panel 14 from flap 40. As illustrated, the side edges of flap 40 are not encompassed by the delamination window 52.

A particularly effective form of deviation from a straight line is a line which contains oscillations. As seen in FIG. 1, line 50 includes along an axis parallel to scoreline 28 a series of oscillations. It has been found that the presence of such oscillations improves the resistance of the partially cut scoreline to folding. Preferably, the wave form includes at least one period, although less than one period may be used. It is especially preferred that the wave form include at least two periods, as is the case for the partially cut line 50 of FIG. 1.

Although the oscillating line may be curved as illustrated in FIG. 1, it need not be so. For instance, in addition to sine waves, other oscillating waves such as those wherein the peaks and troughs of the curves are connected by straight angles rather than curved angles may be employed.

It has been found that the percentage of amplitude of oscillation with respect to the length of the delaminating window may be used as a measure of the usefulness of the curve. Curves are preferred wherein the amplitude of oscillation is 1% or greater with respect to the length of the delaminating window as measured from one end to the other of the oscillating line parallel to the scoreline separating the flap from the carton panel. The length of the delaminating window is taken as a straight line from one end of the oscillating line to the other rather than taken as a length along the curve. It is particularly preferred that the amplitude of oscillation be at least 3% of the length of the delaminating window. Generally higher values will produce better results.

Glue will be applied either or both to the upper surface of the delaminating window and/or the lower surface of the overlying flap 32. What is important is that the overlying flap be glued to the underlying flap at the delamination window. Preferably, substantially the entire delamination window area is glued to the overlying flap 32 and more preferably substantially none of the underlying flap outside of the delamination window area is glued to the overlying flap. The delamination window is cut in the upper surface of the underlying flap which surface faces the lower surface of the overlying flap.

In operation, the carton is assembled by squaring the carton and adhering the glue flap 26 to the rear panel 10 by hot melt or other adhering means. The carton may be produced without the hot sealing gases mentioned in the Meyers patent cited above. The carton is then squared and the minor closure flaps are folded perpendicular to the panels, after which the underlying and then the overlying flaps are folded perpendicular to the panels. At some time prior to folding the overlying flap on top of the underlying flap, adhesive means is applied to one or both to adhere the overlying flap to the delamination window of the underlying flap.

When the consumer wishes to open the carton, he/she grasps the overlying panel 32, which may be provided in a shape for facilitation of grasping. Since the underlying flap is bonded to the overlying flap in the glue delamination window, when the overlying flap is pulled, the delamination window delaminates and the carton is readily opened.

It is contemplated that instead of the illustrated arrangement, the delaminating window could be disposed on the inside of the overlying flap and could be adhered to the outer face of the underlying flap.

The carton may be fabricated from paperboard or other materials susceptible of delamination when a delamination window is formed from partial cuts therein. A chemical adhesive such as glue may be used or hot melt may be used. Hot sealing gases need not and preferably are not employed.

What is claimed is:

1. A carton comprising a closure defined by at least a first flap separated from a first panel of said carton by a first flap separating-foldline and a second flap separated from a second panel of said carton by a second flap separating foldline, one of said flaps including a delamination window formed by partial cuts in its surface facing the other of said flaps, none of said partial cuts which form said delamination window forming a straight line in a direction generally parallel to said foldline separating said window-including flap from said panel, said window-including flap comprising free side edges on either side of said first or second window flap separating foldline, said delamination window not encompassing said side edges, said delamination window including a border generally parallel to the foldline separating the delamination window-including flap from the other panel, said border containing an oscillation.

2. The carton according to claim 1 wherein said cuts form an undulating curve in the direction parallel to said second foldline.

3. The carton of claim 1 wherein the delamination window-including flap is bonded to the other flap in the delamination window.

4. The carton of claim 3 wherein the delamination window-including flap is bonded to the other flap with a chemical adhesive.

5. The carton according to claim 1 wherein said oscillation includes at least one period.

6. The carton according to claim 5 wherein the amplitude of the oscillation is 1% or greater with respect to the length of the delaminating window as measured from one end to the other of the oscillating line.

7. A process of making from a carton blank a package having an underlying flap, and an overlying flap comprising applying adhesive to at least one of (a) an upper surface of the underlying flap and (b) a lower surface of the overlying flap, said flaps comprising an end closure, at least one of said flaps including a delamination window formed by partial cuts in a surface facing the other of said flaps, said flaps being separated from carton panels by respective foldlines, none of said partial cuts which form the delamination window forming a straight line in a direction generally parallel to said foldlines, said adhesive being applied so that it will be disposed within said delamination window when said flaps are adhered together, said window-including flap comprising free side edges on either side of said window flap-separating foldline, said delamination window not encompassing said side edges.

8. A carton comprising a closure defined by at least an overlying flap separated from a first panel of said carton by a first foldline and an underlying flap separated from a second panel of said carton by a second foldline, said underlying flap including a delamination window formed by partial cuts in its upper surface, none of said partial cuts which form said delamination window forming a straight line in a direction generally parallel to said second foldline, said overlying flap being bonded to said delamination window, said window-including flap comprising free side edges at either end of said window flap-separating foldline, said delamination window not encompassing said side edges, said delamination window-including a border generally parallel to the foldline separating the delamination window-including flap from the other panel, said border containing an oscillation.

9. The carton of claim 8 wherein the delamination window-including flap is bonded to the other flap in the delamination window.

10. The carton of claim 9 wherein the delamination window-including flap is bonded to the other flap with a chemical adhesive.

11. The carton according to claim 8 wherein said oscillation includes at least one period.

12. The carton according to claim 11 wherein the amplitude of the oscillation is 1% or greater with respect to the length of the delamination window as measured from one end to the other of the oscillating line.

13. A carton comprising a closure defined by at least a first flap separated from a first panel of said carton by a first foldline, a second flap opposed to said first flap separated from a second panel of said carton by a second foldline, and opposed side flaps disposed between said first and second flaps, said first flap including a delamination window formed by partial cuts in its surface, none of said partial cuts which form said delamination window forming a straight line in a direction generally parallel to said first foldline, said side flaps being free of lateral attachment to said delamination window containing flap, said delamination window including a border parallel to the foldline separating the delamination window-including flap from the first or second panel and the border containing an oscillation.

* * * * *